United States Patent [19]

Snelling et al.

[11] 3,944,353

[45]*Mar. 16, 1976

[54] BACKGROUND REDUCTION

[75] Inventors: Christopher Snelling; William S. Little, both of Penfield; Robert H. Townsend, Webster, all of N.Y.

[73] Assignee: Xerox Corporation, Stamford, Conn.

[ * ] Notice: The portion of the term of this patent subsequent to Feb. 29, 1989, has been disclaimed.

[22] Filed: Mar. 1, 1973

[21] Appl. No.: 337,247

Related U.S. Application Data

[60] Division of Ser. No. 206,467, Dec. 6, 1971, Pat. No. 3,737,310, which is a continuation of Ser. No. 863,608, Oct. 3, 1969, abandoned.

[52] U.S. Cl. ..... 355/3 P; 204/299 PE

[51] Int. Cl.[2] ..... G03G 15/22

[58] Field of Search ..... 355/3 P, 4, 17; 204/181 PE, 299 PE, 300 PE; 96/1 PE, 1.3

[56] References Cited

UNITED STATES PATENTS

| | | | |
|---|---|---|---|
| 3,427,242 | 2/1969 | Mihajlov | 355/3 P UX |
| 3,535,221 | 10/1970 | Tulagin | 204/181 PE |
| 3,561,864 | 2/1971 | Carreira | 355/3 P |
| 3,601,483 | 8/1971 | Carreira et al. | 355/3 P |
| 3,634,221 | 1/1972 | Tulagin et al. | 204/181 PE X |
| 3,645,874 | 2/1972 | Wells | 204/181 PE |
| 3,784,294 | 1/1974 | Wells | 355/3 P |

*Primary Examiner*—L. T. Hix
*Assistant Examiner*—Kenneth C. Hutchison

[57] ABSTRACT

Photoelectrophoretic imaging system having an additional electrode for subjecting a film of photoelectrophoretic imaging suspension to an electric field at a potential above the corona threshold of the film prior to image exposure. The effect of the electric field and resulting current causes electrophoretic deposition of the imaging particles in the imaging suspension in a uniform layer to thereby eliminate or reduce background degradation in the final image formed.

12 Claims, 1 Drawing Figure

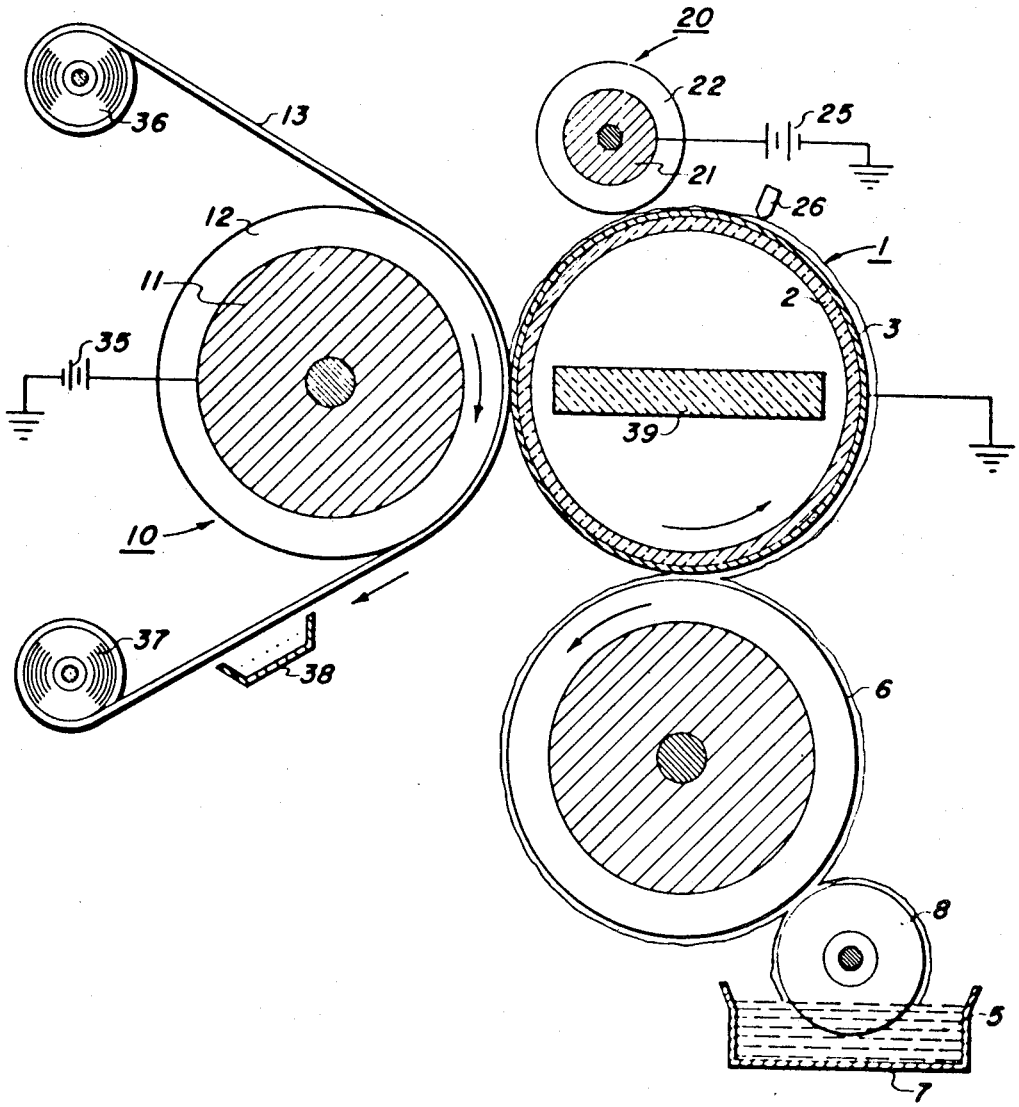
20
22
25
21
26
36
13
12
1
11
2
3
35
39
10
37
38
6
8
5
7

BACKGROUND REDUCTION

CROSS REFERENCE TO RELATED APPLICATIONS

This is a division of application Ser. No. 206,467, filed Dec. 6, 1971, now U.S. Pat. No. 3,737,310, which application is a continuation of application Ser. No. 863,608, filed Oct. 3, 1969, now abandoned.

BACKGROUND OF THE INVENTION

This invention relates to an imaging system and more specifically to an electrophoretic imaging system.

In photoelectrophoretic imaging colored photosensitive particles are suspended in an insulating carrier liquid. This suspension is then placed between at least two electrodes subjected to a potential difference and exposed to a light image. Ordinarily, in carrying out the process the imaging suspension is placed on a transparent electrically conductive support in the form of a thin film and exposure is made through the transparent support while a second generally cylindrically shaped biased electrode is rolled across this suspension. The particles are believed to bear an initial charge once suspended in the liquid carrier which causes them to be attracted to the transparent base electrode and upon exposure, to change polarity by exchanging charge with the base electrode so that the exposed particles migrate to the second or imaging electrode thereby forming images on each of the electrodes, by particle subtraction, each image being complementary one to the other. The process may be used to produce both polychromatic and monochromatic images. In the latter instance a single color photoresponsive particle may be used in the suspension or a number of differently color photoresponsive particles may be used all of which will respond to the light to which the suspension is exposed. An extensive and detailed description of the photoelectrophoretic imaging techniques as generally referred to may be found in U.S. Pat. Nos. 3,383,993, 3,384,488, 3,384,565 and 3,384,566, and are hereby incorporated by reference.

In the case of the polychromatic imaging process the imaging suspension will contain a plurality of at least two differently colored finely divided particles in the carrier liquid each of said particles comprising an electrically photosensitive pigment whose principal light absorption band substantially coincides with its principal photosensitive response. Thus, the pigment represents both the primary electrically photosensitive ingredient and the primary colorant for the specific particle in suspension. The particles utilized in the polychromatic system preferably have intense pure colors and are highly photosensitive. When the suspension is exposed to a multicolored image, particles will migrate to one electrode in proportion to the intensity of the light which they absorb. Thus, upon exposure, particles selectively remain on one of the electrodes in image configuration with complementary particles migrating to the other of the electrodes in this system. For example, when a mixture comprising cyan, magenta and yellow particles is exposed to an image whereby yellow light impinged the imaging suspension, the cyan and magenta particles will migrate leaving behind an image made up of the yellow pigment particles. Similarly, when exposed to a multicolored image different colored particles absorb light of their complementary color in the appropriate image areas and migrate thereby leaving a full colored image behind corresponding to the original.

Although the above described imaging systems and processes have been found to be highly satisfactory one of the more troublesome problems encountered has to do with the elimination of background resulting from the migration and desposition of unwanted pigment particles. In the case of the monochrome imaging process the background deposition plays a more noticeable role in its effects upon the resulting image. In the polychrome process although not as noticeable the deposition of unwanted pigment particles also effects the overall quality of the color image in a detrimental manner.

It is, therefore, an object of this invention to provide an electrophoretic imaging system which will overcome the above noted disadvantages.

It is a further object of this invention to provide a photoelectrophoretic imaging process capable of producing high quality images.

It is another object of this invention to provide a novel photoelectrophoretic imaging process.

Yet still a further object of this invention is to provide a novel photoelectrophoretic imaging apparatus.

It is still a further object of this invention to provide a high contrast imaging system.

SUMMARY OF THE INVENTION

The foregoing object and others are accomplished in accordance with the present invention, generally speaking by providing an imaging suspension comprising colored photoelectrophoretic imaging particles in an insulating carrier liquid. The imaging suspension is interpositioned between at least two electrodes one of which is substantially transparent, subjected to a potential difference and selectively exposed to a reproducible image by a source of activating electromagnetic radiation. The imaging suspension is generally coated on the surface of a first transparent electrode in the form of a thin film and the exposure made through the transparent electrode generally during the period of contact with a second or imaging electrode. Prior to image exposure the film of imaging suspension is subjected to an electric field by way of still another electrode at a potential above the corona threshold of the film thereby establishing the necessary corona discharge current which splits or otherwise separates the imaging suspension substantially into two layers wherein the photoelectrophoretic pigment particles are effectively rendered unipolar and are substantially concentrated on the surface of the first electrode upon which the suspension is initially coated. Thus, the effect of the field and resulting current is to cause an electrophoretic deposition of the imaging particles in the form of a uniform film on the respective electrode thereby creating in essence a two layered film consisting of unipolar particles and vehicle, respectively. The photomigratory particles present in the suspension next respond to the exposure radiation in the imaging zone to form a visible image pattern at one or both of the electrodes, the images being complementary in nature. The imaging suspension employs intensely colored pigment particles which serve both as the colorant and as the photosensitive material. Additional photosensitive elements or materials are not required thus providing a very expedient imaging process. The particles respond to light in the regions of the spectrum of the principal absorption band with, for example, cyan, magenta, and yellow particles responding to red, green and blue light respectively. Thus, if a specific pigment is impinged by white light then it can be expected to respond to produce an image.

It has been determined that by subjecting the imaging suspension of the present invention to a D.C. corona discharge current of sufficient magnitude prior to the imagewise exposure of the suspension that the background heretonow experienced in the final image may be effectively eliminated. The effect of the electric field and resulting corona current is to make the photoconductive particles essentially unipolar prior to imaging and to deposit them uniformly on the respective electrode prior to exposure so that at high speeds high quality, background free images may be produced. When used in the course of the present invention the expression "corona threshold potential or voltage" refers to that voltage at which air ionization occurs in the air gap between the particular liquid film and the respective electrode surface.

DETAILED DESCRIPTION OF THE INVENTION

The invention is further illustrated in the accompanying drawing in which there is seen a continuous photoelectrophoretic duplicator comprising a transparent injecting electrode 1, an imaging electrode 10 and a film-splitting electrode 20. The transparent electrode 1, in the instant illustration, is represented as consisting of a layer of optically transparent glass 2 overcoated with a thin optically transparent electrically conductive layer of tin oxide 3. Tin oxide coated glass of this nature is commercially available from Pittsburgh Plate Glass Co. under the trade name "NESA" glass. A uniform layer of the imaging suspension 5 of the present invention is coated on the surface of the transparent electrode by an applicator roller 6 of any suitable design or material, such as a urethane coated cylinder, which may rotate in the opposing direction, as herein represented, or the same direction to the transparent cylinder. The function of the ink applicator is to apply a thin film of the imaging suspension from ink sump 7 by way of roller 8 to the transparent cylinder. In close proximity to the transparent roller electrode 1 is a second rotary electrode 10 having a conductive central core 11 which is covered with a layer 12 of material capable of blocking D.C. current such as polyurethane, which will be referred to as a blocking layer. Although a blocking layer such as this need not be used in the system, the use of such a layer is preferred because of the markedly improved results which it is capable of producing. A detailed description of the improved results and the types of materials which may be employed as the blocking layer may be found in U.S. Pat. No. 3,383,993.

The imaging suspension will consist of a dispersion of specifically colored, finely divided photosensitive particles in an insulating carrier liquid or vehicle. Any suitable differently colored photosensitive pigment particle may be used such as disclosed in U.S. Pat. Nos. 3,384,566 and 3,384,565. When the system is to be used in its preferred mode in conjunction with monochromatic photoelectrophoretic imaging then the imaging suspension will contain a plurality of pigment particles in a carrier liquid the pigment portion of which provides both the photosensitivity and colorant property for the particle. In the case of a polychrome system the suspension will contain a plurality of at least two differently colored particles having similar properties to those used in the monochrome process. Inasmuch as background reduction is the primary effect realized in the present system the desired mode of operation is as represented by the illustration with imaging occurring at the surface of the electrode which contacts only the clear vehicle, that being the surface of the imaging electrode. Thus, in a polychrome system the input is in the form of a masked color negative such as Kodacolor. In an alternate embodiment, the suspension may be coated on the imaging electrode as depicted in U.S. Pat. No. 3,427,242, with the appropriate biased electrodes added, whereby the color image is produced directly by migration of the image particles to the surface of the transparent roller electrode. Although not preferred, the latter alternate embodiment demonstrates the versatility of the system. If desirable a polychrome image may be prepared according to monochrome imaging in registration utilizing the proper color separation negatives as disclosed in U.S. Pat. application Ser. No. 812,796, filed Apr. 2, 1969 having a common assignee. The imaging suspension may also contain a sensitizer and/or binder for the pigment particles. The percentage of pigment in the carrier is not considered critical; however, for reference purposes it is noted that from about 2 to 10 percent pigment by weight has been found to produce acceptable results.

A receiver sheet 13 is driven between cylinders 1 and 10 as represented, with an ink image being selectively deposited on the receiver sheet in the imaging zone. A reverse image pattern is formed on the NESA glass cylinder which is removed at the ink application station. Thus, the applicator performs both the ink application and residual image removal steps.

Located in close proximity to the area of contact between the transparent and imaging electrodes is a third electrode designated 20 consisting of a conductive central core 21 covered with a layer of a dielectric material 22. Any suitable dielectric material may be used at this stage of the invention. Typical dielectric materials include elastomeric materials such as polyurethane elastomer (Disogrin Industries) silicone rubber RTV (General Electric Co.); Neoprene, a type of elastomer based on polymers of 2-chlorobutadiene-1,3; fluorelastomers such as Dow Corning's fluorosilicone elastomers and Viton available from duPont; natural and vulcanized rubbers; polyvinylfluoride plastics such as Tedlar (duPont) and KYNAR (Pennsalt Corp.); polyester plastics such as polyurethane (Witco Co.); acrylonitrile polymers such as Hylar (B. F. Goodrich); mixtures and copolymers thereof. As the film of imaging suspension 5 coated on the surface of the transparent electrode 1 passes beneath the film-splitting electrode 20, a D.C. potential is applied to the latter electrode by potential source 25. The effect of the resulting field and established corona current across the air gap and the imaging suspension is to charge substantially all the photosensitive particles present in the imaging suspension to the polarity of the charging roller and, in addition, to concentrate the particles at the surface of the transparent electrode by electrophoretic migration. Thus, a layer of highly concentrated, unipolar pigment is deposited on the imaging electrode with a layer of relatively clear liquid vehicle above it. When this layered suspension enters the imaging zone at the area of contact of the transparent electrode 1 with the imaging electrode 10 the layer contacting the potential image support, whether it be the electrode surface itself or a sheet-like web positioned between the electrode surfaces as herein represented, will be substantially free of pigment particles thereby minimizing the possibility of contaminating the image support surface. A means 26 for metering the ink flow passing between the film-splitting electrode and the transparent electrode is included in the system to control total ink film thickness and to eliminate ink flooding which otherwise tends to suppress corona thereby nullifying the effect of the corona current upon the imaging suspension.

The potential applied to the film-splitting electrode is generally maintained at a value above the corona threshold potential for the air gap between the liquid film 5 and roller 20. The primary concern is that sufficient D.C. corona current be generated to cause the particles in the suspension to become unipolar and to establish the two-layered film. Voltages effectively applied in the course of the present invention at film thicknesses of about 1–2 microns are generally greater than 2,500 volts. At ink film thicknesses greater than 2 microns the corona threshold is generally found to be somewhat greater than 3,500 volts. For maximum assurance of the desired effect being obtained, preferred voltages are in a range of from about 5,000 to 8,000 volts. The polarity of the potential applied to the film-splitting roller is generally maintained at the same sense as that applied to the imaging electrode.

The layered suspension enters the imaging zone between the transparent and imaging electrodes where an image is projected into the nip of the rollers by way of the first surface mirror designated 39. A field is established across the imaging zone as the result of power source 35. Through the entire operation the NESA glass roller electrode is connected to ground. The receiver sheet 13 represented in the form of a paper web is fed from supply roll 36 passes between the glass injecting electrode and the imaging electrode and is rewound on take-up roller 37. Fixing of the image developed on the surface of the copy web 13 may be accelerated by the presence of heating unit 38 which assists in vaporizing the carrier component remaining in combination with the colored pigment particles.

Although the film-splitting roller may be positioned generally at any point between where the imaging suspension is coated on the transparent electrode and the imaging zone it is preferred that the film-splitting roller be located as close as possible to the area of contact between the imaging roller and the transparent injecting electrode so as to decrease the time for dark discharge of the unipolar particles to occur prior to imaging.

Any suitable insulating carrier liquid may be used in the course of the present invention. Typical vehicles include decane, dodecane, tetradecane, molten paraffin wax, molten beeswax and other molten thermoplastic materials, Sohio Odorless Solvent, a kerosene fraction available from Standard Oil Compnay of Ohio, Isopar G a branched chain saturated aliphatic hydrocarbon mixture available from Humble Oil Company of New Jersey, olive oil, mineral oil, linseed oil, sunflower seed oil, cottonseed oil, marine oils such as sperm oil and cod liver oil, silicone oil such as dimethyl polysiloxane (Dow Corning Co.), castor oil, corn oil, peanut oil, fluorinated hydrocarbons such as Freon (duPont) and compatible mixtures thereof.

A wide range of voltages may be applied between the electrodes in the system at which imaging occurs. In the case of the field established across the imaging suspension in the imaging zone it is preferred in order to obtain good image resolution and density that the field across the imaging suspension be at least 5 volts/micron and preferably about 20 volts/micron or more such as to create an electric field of at least about 300 volts. The applied potential necessary to obtain the field of strength will, of course, vary depending upon the inter-electrode gap and upon the thickness and type of blocking material used on the respective imaging electrode surface. The preferred voltages normally exceed the corona threshold at about 3,500 v in order to maintain the desired layering effect created by roller electrode 20 and to obviate premature dark discharge and background migration of the particles. Voltages as high as 8,000 volts have been applied to produce images of high quality. The upper limit of the field strength appears to be limited only by the breakdown potential of the suspension and blocking material.

When the imaging suspension passes between the transparent electrode and the film-splitting roller the particles are unipolarized and driven so as to uniformly deposit within the carrier on the surface of the transparent electrode thus presenting a two-layered film with the vehicle being the most superficial or outermost layer. The imaging suspension is then carried into the imaging zone between the transparent electrode and the imaging roller. Imaging as carried out in conjunction with the process of the present invention will generally be in a negative to positive or positive to negative imaging mode. Thus, for purposes of the present discussion in order to produce a positive image on the receiver sheet a negative image is projected through the imaging suspension at the imaging zone. As discussed above, a potential is applied across the imaging suspension and as a result of the exposure, the exposed pigment particles initially suspended in the carrier liquid and, as a result of the effect of the film-splitting roller now uniformly plated on the surface of the transparent electrode, migrate upon exposure to the actinic radiation through the carrier to the surface of the imaging roller or, in the instance of the above described illustration, to the surface of the intervening receiver paper sheet. The pigment image formed, whether it be on a removable blocking electrode layer attached to the conductive core of the imaging roller or, as in the instant illustration, to a receiver copy sheet, may be fixed in place, for example by placing a lamination over its top surface such as by spraying with a thermoplastic composition, or by removal of residual solvent aided by the application of heat, or, if desired, the image may be transferred to a secondary substrate to which it is in turn fixed. The system herein described produces a high contrast monochromatic image or polychromatic image with little or no background either in a positive to negative or negative to positive imaging mode.

If the image is formed directly on the electrode surface (e.g. if the intervening receiver sheet is eliminated), it will be found desirable to transfer the image from the electrode and fix it on a secondary substrate so that the electrode may be reused. Such a transfer step may be carried out by adhesive pickoff techniques or preferably by electrostatic field transfer while the image is still wet. If the imaging roller is covered with a transfer paper sleeve or, as illustrated, a web is passed between the contacting surfaces of the transparent and imaging rollers, or if the blocking material utilized consists of a removable sleeve, such as Tedlar, this sleeve will pick up the complete image on the initial pass and need only be removed to produce the final usable copy. All that is required is to replace the sleeve with a similar material. In the present configuration set out in the illustration, images are produced directly on a paper receiving sheet or other substrate with the image formed on the NESA or transparent cylinder removed by the action of the ink applicator. However, if desired, the image formed on the NESA cylinder need not be discarded but may be utilized by offsetting the image from the NESA cylinder onto the surface of a conventional receiving sheet, such as described above. Any suitable material may be used as the receiving substrate for the image produced such as paper as represented in the illustration or other desirable substrates. For example, if one desires to prepare a transparency the use of Mylar (polyethylene terephthalate) or cellulose acetate sheet might be desirable.

It is to be understood that it is not intended that the structural arrangement of the apparatus represented by the illustration be restricted to the design as set out herein and all similar configurations which will satisfy the requirements of the present invention are contemplated. For example, although the imaging electrode or roller is represented as a cylinder it may also take the form of a flat plate electrode as may the injecting or NESA electrode. Furthermore, depending upon the specific configuration of the electrodes in the system and other aspects of the system either electrode which participates in the direct imaging step could be optically transparent and exposure made through it.

When used in the course of the present invention the term injecting electrode should be understood to mean that it is an electrode which will preferably be capable of exchanging charge with the photosensitive particles of the imaging suspension when the suspension is exposed to light so as to allow for a net change in the charge polarity on the particle. By the term blocking electrode or layer is meant one which is substantially incapable of injecting charge carriers into the photosensitive particles when the particles come into contact with the surface of the respective electrode. The use of a blocking layer serves to eliminate particle oscillation in the system.

An additional beneficial effect realized by the introduction of the film-splitting roller into the system of the present invention when certain pigment suspensions are used such as a phthalocyanine pigment suspension is an electroviscous effect whereby the potential applied to the film-splitting roller effectively increases the viscosity of the ink suspension. This to some extent increases the force of the ink against the surface of the film-splitting roller thereby allowing more ink to traverse the nip or area of contact between the roller and the transparent electrode. Thus, when electroviscous inks are used, the introduction of a biased film-splitting roller may also serve, in conjunction with the other metering devices used, to control the total ink film thickness presented to the imaging zone.

It is preferred that the injecting electrode be composed of an optically transparent material, such as glass, overcoated with a conductive material such as tin oxide, copper, copper iodide, gold or the like; however, other suitable materials including many semiconductive materials such as a cellophane film, which are ordinarily not thought of as being conductors but which are still capable of accepting injected charge carriers of the proper polarity from the imaging particles under the influence of an applied electric field may be used within the course of the present invention. The use of more conductive materials allows for cleaner charge separation and prevents possible charge buildup on the electrode. The blocking layer of the imaging electrode, on the other hand, is selected so as to prevent or greatly retard the injection of electrons into the photosensitive pigment particles when the particles reach the surface of this electrode. The core of this imaging electrode generally will consist of a material which is fairly high in electrical conductivity. Typical conductive materials including conductive rubber, and metal foils of steel, aluminum, copper and brass have been found suitable. Preferably, the core of the electrode will have a high electrical conductivity in order to establish the required field differential in the system; however, if a material having a low conductivity is used a separate electrical connection may be made to the back of the blocking layer of the blocking or imaging electrode. For example, the blocking layer or sleeve may be a semiconductive polyurethane material having a conductivity of from about $10^{-8}$ to $10^{-9}$ ohm-cm. If a hard rubber non-conductive core is used then a metal foil may be used as a backing for the blocking sleeve. Although a blocking layer need not necessarily be used in the system, the use of such a layer is preferred because of the markedly improved results which it is capable of producing. It is preferred that the blocking layer, when used, be either an insulator or a semiconductor which will not allow for the passage of sufficient charge carriers, under the influence of the applied field, to discharge the particles finely bound to its surface thereby preventing particle oscillation in the system. The result is enhanced image density and resolution. Even if the blocking layer does allow for the passage of some charge carriers to the photosensitive particles it still will be considered to fail within the class of preferred materials if it does not allow for the passage of sufficient charge so as to recharge the particles to the opposite polarity. Exemplary of the preferred blocking materials used are baryta paper, Tedlar (a polyvinylfluoride), Mylar (polyethylene terephthalate) and polyurethane. Any other suitable material having a resistivity of about $10^7$ ohms-cm. or greater may be employed. Typical materials in this resistivity range include cellulose acetate coated papers, cellophane, polystyrene and polytetrafluoroethylene. Other materials that may be used in conjunction with the injecting and blocking electrodes and other photosensitive particles which may be used as the photomigratory pigments and the various conditions under which the process operates may be found in the above cited issued patents, U.S. Pat. Nos. 3,384,565 and 3,384,566 as well as U.S. Pat. Nos. 3,384,488 and 3,383,993.

It is to be understood that any suitable photosensitive pigment particle as identified in the above cited patents may be employed within the course of the present invention with the selection depending largely upon the photosensitivity and the spectral sensitivity required. Typical photoresponsive materials include substituted and unsubstituted organic pigments such as phthalocyanines, for example Monarch Blue G, beta form of copper phthalocyanine available from Hercules, Inc., quinacridones as for example Monstral Red B available from duPont, Algel Yellow (1,2,5,6-di(C,C'-diphenyl)-diazoanthraquinone) (C.I. 67300), Irqazine Red, trisodium salt of 2-carboxyl phenyl azo(2-naphthiol-3,6-disulfonic acid (C.I. 16105), 3-benzylidene aminocarbazole, 3-aminocarbazole, Watchung Red L (1-4'- methyl-5′-chloroazobenzene-2′-sulfonic acid)-2-hydroxy-3-naphthoic acid) (C.I. 15865), a yellow pigment identified as Yellow 96 comprising N-2″-pyricyl-8,13-dioxodinaphtho-(2,1-b; 2′,3′-d)-furan-6-carboxamide, and inorganic pigments such as cadmium sulfide, cadmium selenide, selenium, antimony sulfide, arsenic sulfide, zinc oxide and mixtures thereof. The imaging suspension may contain one or more different photosensitive particles each having various ranges of spectral response.

PREFERRED EMBODIMENTS

To further define the specifics of the present invention the following examples are intended to illustrate and not limit the particulars of the present system. Parts and percentages are by weight unless otherwise indicated.

In the following examples the NESA electrode consists of a 6 inch diameter Pyrex glass cylinder concentric to about 0.001 inch with a conductive tin oxide coating. The imaging or blocking electrode consists of a 4 inch diameter conductive steel core with a ¼ inch thick layer of polyurethane forming the blocking layer. The film-splitting (background control) electrode consists of a ½ inch diameter aluminum core covered with a ¼ inch layer of polyurethane.

EXAMPLE I

A cyan ink suspension consisting of 4.0 grams x-phthalo-cyanine, 2.0 grams tricresyl phosphate (TCP), 0.05 grams beta carotene and about 160 cc's sperm oil is supplied to a tin oxide coated glass cylinder from a urethane sponge. The film of imaging suspension is metered to a thickness of about 3 microns. As the film passes the nip between the film-splitting roller and the NESA electrode a potential of about +7,000 volts is applied across the imaging suspension. As the imaging suspension proceeds to the nip between the NESA and imaging electrode a negative image is projected into the imaging zone. A field of about +8,000 volts is developed across the imaging suspension during exposure. A 500 watt quartz iodine light source illuminates the film negative. The light passes through an optical system and is projected into the nip by way of a first surface mirror. Cyan pigment particles are selectively deposited onto a paper receiver sheet in the imaging zone. The x-phthalocyanine is prepared according to the process set out in U.S. Pat. No. 3,357,989, issued Dec. 12, 1967 and having a common assignee. High quality low background images are obtained with a character density of 1.2, and a background density of 0.01, at an operating speed of about 7 inches/second. The above procedure is repeated with the film-splitting roller disconnected. Background is now observed to be 0.3, image density still about 1.2.

EXAMPLE II

The process of Example I is repeated with the exception that a magenta ink suspension consisting of 8.0 grams Monastral Violet, 2.0 grams of TCP, 0.05 grams of beta carotene and 106 cc's sperm oil. The film is coated to a thickness of about 4 microns. The potential applied to the film-splitting roller is about +8,000 volts. Operating speed is about 5 inches/second. Again a low background magenta image is formed on the surface of the paper receiver sheet which passes between the nip of the NESA and imaging electrodes. Image density is about 1.0, background density measures 0.02. The Monastral Violet is commercially available from E.I. duPont de Nemours & Co.

The above procedure is repeated with the film-splitting roller disconnected. Background is now observed to be 0.4, image density still about 1.0.

EXAMPLE III

The process of Example I is repeated with the exception that a yellow ink suspension comprising 20 grams Shepherd Golden Yellow No. 55, 2 grams TCP, 0.05 grams beta carotene and 106 cc's Sohio Odorless Solvent is substituted for the cyan imaging suspension. The film-splitting roller has a potential of about −6000 v and the imaging roller a potential of about −7000 v. The yellow pigment is commercially available from the Shepherd Chemical Company. Operating speed is about 5 inches/second. A high quality, low background yellow image is obtained having a background density of 0.01.

The above procedure is repeated with the film-splitting roller disconnected. Background is now observed to be 0.25, image density still about 1.2.

EXAMPLE IV

The process of Example I is repeated with the exception that a tri-mix imaging suspension is utilized in place of the cyan suspension. The tri-mix suspension consists of equal amounts of Watchung Red B, a barium salt of 1-(4′-methyl-5′-chloro-2′-sulfonic acid) azobenzene-2-hydroxy-3-naphthoic acid, C.I. No. 15865, Monolite Fast Blue GS, a mixture of alpha and beta metal free phthalocyanine, available from Arnold Hoffman Co., C.I. No. 74100 and a proprietary yellow pigment N-2″-pyridyl-8,13-dioxodinaphtho- (2,1-b; 2′, 3′d) furan-6-carboxamide, more fully defined in U.S. Patent application Serial No. 421,281 now U.S. Pat. No. Re. 27,117 having a common assignee, in mineral oil with the total pigment constituting about 8% by weight of the imaging suspension. The input information is a Kodacolor negative. A positive polychrome image is formed on the receiver sheat displaying a low background density of 0.05 at an operating speed of 2 inches/second.

Although the present examples are specific in terms of conditions and materials used, any of the above materials may be substituted when suitable with similar results being obtained. In addition to the steps used to carry out the process of the present invention other steps or modifications may be used if desirable. For example more than one film-splitting electrode may be utilized. In addition, a polychrome image may be formed by first preparing color separation negatives of a color print and then, utilizing the resulting color separation negatives, produce monochrome images of the corresponding colors in registration at three separate imaging stations. Alternatively, each image may be reproduced and transferred in registration or each image may be produced on a single transparent sheet and the resulting imaged sheets placed one on top of the other in registration to produce a transparent overlay for projection purposes. In addition, other materials may be incorporated in the imaging suspension, various different voltages may be applied, film thicknesses utilized and the speeds may be varied in a manner which will enhance, synergize or otherwise desirably effect properties of the present system. For example, various sensitizers may be included in the imaging suspension which will enhance the final results.

Those skilled in the art will have other modifications occur to them based on the teachings of the present invention. These modifications are intended to be encompassed within the scope of this invention.

What is claimed is:

1. A photoelectrophoretic imaging apparatus comprising in combination:

a. an optically transparent first electrode having a surface capable of supporting a layer of imaging suspension thereon;

b. means for introducing a layer of imaging suspension to the surface of said first electrode;

c. a second electrode mounted in close proximity to said first electrode so as to make contact with a surface of a layer of imaging suspension carried on said first electrode surface thereby defining a nip having an air gap on each side thereof;

d. means to apply a first potential difference across a layer of imaging suspension carried on said first electrode surface between said first electrode and said second electrode;

e. a third electrode mounted in close proximity to said first electrode so as to make contact with a surface of a layer of imaging suspension carried on said first electrode surface thereby defining a nip having an air gap on each side thereof;

f. means to expose with actinic electromagnetic radiation of an image to be reproduced, that portion of a layer of imaging suspension at an area of closest proximity of said third electrode and said first electrode;

g. means to apply a second potential difference across a layer of imaging suspension carried on said first electrode surface, between said third electrode and said first electrode during said exposure; and h. means to cause relative movement between said first electrode and said second and third electrodes.

2. Apparatus according to claim 1 wherein said means to apply a second potential difference comprises means to apply a potential difference in the range of from 3,500 volts to 8,000 volts D.C.

3. Apparatus according to claim 2 further comprising means for advancing a receiving member between said first electrode and said third electrode at the areas of closest proximity of said third electrode and said first electrode.

4. Apparatus according to claim 1 wherein said first electrode is cylindrically shaped having a longitudinal axis and wherein said means to expose is positioned to project an image along said longitudinal axis of said first electrode into said nip formed between a layer of imaging suspension carried by said first electrode and said third electrode.

5. Apparatus according to claim 1 wherein said means to apply a first potential difference comprises means to apply a potential difference above the corona threshold for said air gap on each side of the nip formed between a layer of imaging suspension carried on said first electrode surface and said second electrode.

6. Apparatus according to claim 5 wherein said means to apply a first potential difference comprises means to apply a potential difference in the range of from 3,500 to 8,000 volts D.C. and of the same polarity as said second potential difference.

7. Apparatus according to claim 1 wherein each of said electrodes is a rotatably mounted roller.

8. Apparatus according to claim 7 further comprising means for rotating each of said electrodes in synchronization.

9. Apparatus according to claim 1 further comprising means for controlling said first potential difference so as to maintain concentration of pigment in a layer of imaging suspension carried on said first electrode surface relatively constant and at the desired level.

10. Apparatus according to claim 1 wherein said second electrode is a pre-imaging roller electrode.

11. A photoelectrophoretic imaging apparatus comprising in combination:

a. an optically transparent, flat plate, first electrode having a surface capable of supporting a layer of imaging suspension thereon;

b. means for introducing a layer of imaging suspension to the surface of said first electrode;

c. a second electrode mounted in close proximity to said first electrode such that said second electrode can make progressively advancing contact with a surface of a layer of imaging suspension carried on the surface of said first electrode;

d. means to apply a first potential difference across a layer of imaging suspension carried on said first electrode surface, between said first electrode and said second electrode;

e. a third electrode mounted in close proximity to said first electrode such that said third electrode can make progressively advancing contact with a surface of a layer of imaging suspension carried on said first electrode;

f. means to expose with actinic electromagnetic radiation of an image to be reproduced, that portion of a layer of imaging suspension carried on said first electrode at an area of contact of said third electrode and said first electrode;

g. means to apply a second potential difference across a layer of imaging suspension carried on said first electrode between said third electrode and said first electrode during said exposure; and h. means to cause relative movement between said first electrode and said second and third electrodes.

12. Apparatus according to claim 11 wherein said second electrode and said third electrode are rotatably mounted rollers.

* * * * *